US006022041A

United States Patent [19]

Dailey et al.

[11] Patent Number: 6,022,041

[45] Date of Patent: Feb. 8, 2000

[54] ADAPTER ASSEMBLY FOR PIVOTABLE MOUNTING OF A BINDING TO A SNOWBOARD

[75] Inventors: Matthew Robert Dailey, 801 Clay Ave., Scranton, Pa. 18510; Thomas Kent Wilhelm, Dallas, Pa.; Bernard Milton Dymond, Jr., Shickshinny, Pa.; John Chrusciel, Carbondale, Pa.

[73] Assignee: Matthew Robert Dailey, Scranton, Pa.

[21] Appl. No.: 09/031,967

[22] Filed: Feb. 27, 1998

[51] Int. Cl.[7] ..... A63C 9/00

[52] U.S. Cl. ..... 280/618; 280/14.2

[58] Field of Search ..... 280/613, 617, 280/618, 620, 629, 634, 14.2; 441/70

[56] References Cited

U.S. PATENT DOCUMENTS

| | | | |
|---|---|---|---|
| 5,028,068 | 7/1991 | Donovan | 280/618 |
| 5,577,755 | 11/1996 | Metzger et al. | 280/14.2 |
| 5,667,237 | 9/1997 | Lauer | 280/607 |
| 5,791,678 | 8/1998 | Perlman | 280/618 |
| 5,803,481 | 9/1998 | Eaton et al. | 280/14.2 |
| 5,826,910 | 10/1998 | Ricks et al. | 280/618 |
| 5,890,729 | 4/1999 | Bayer et al. | 280/618 |
| 5,947,488 | 9/1999 | Gorza et al. | 280/14.2 |

FOREIGN PATENT DOCUMENTS

| | | | |
|---|---|---|---|
| 2627097 | 8/1989 | France | 280/14.2 |
| 678278 | 8/1991 | Switzerland | 280/14.2 |

*Primary Examiner*—J. J. Swann
*Assistant Examiner*—Frank Vanaman
*Attorney, Agent, or Firm*—Akin, Gump, Strauss, Hauer & Feld, L.L.P.

[57] ABSTRACT

An adapter assembly for pivotable mounting of a binding to a snowboard is provided. The adapter assembly includes a first part which is adapted to be one of mounted to a snowboard and connected to a binding. A second part is rotatably connected to the first part for rotation about an axis. The second part is adapted to be the other of mounted to the snowboard and connected to the binding. The first part includes an index member having a plurality of index stops spaced at least partially around the axis. A locating member is connected to the second part which is movable from a first position, where the locating member is engaged in an index stop of the index member such that the second part is held in a rotatably fixed position relative to the first part, to a second position, where the locating member is disengaged from the index stops of the index member such that the second part is rotatable relative to the first part. A repeat stop selector is also provided which is positionable relative to the index member for realignment of the locating member with a pre-selected one of the index stops after movement of the first part relative to the second part.

14 Claims, 4 Drawing Sheets

ADAPTER ASSEMBLY FOR PIVOTABLE MOUNTING OF A BINDING TO A SNOWBOARD

BACKGROUND OF THE INVENTION

The present invention relates to a snowboard binding for engaging a user's foot to a snowboard, and more particularly, to bindings which may be rotated with respect to the snowboard and returned to a desired position.

Snowboarding has become a popular sport in recent years. A snowboard is a relatively broad, generally ski-shaped device having two bindings mounted on the top surface in which a user places his feet. Unlike skiing, both of the user's feet are located in a fixed position relative to one another on the snowboard during use. Due to the method of riding, the bindings are generally spaced one behind the other and are arranged such that the user's feet are directed generally toward the same side of the board.

Due to the different sizes of users and the different types of boards, for example those used for downhill, slalom or super G events, as opposed to half-pipe, and/or recreational use, the binding locations on the boards will vary greatly from user to user. Additionally, due to variations in riding conditions and/or terrain at different courses, it may be desirable to vary the direction of the bindings relative to the board and to one another, even for the same user. For instance, for use on a gradual slope, a user may prefer more or less opening to the angle between the front and back foot than when going down a steeper slope.

Due to the increasing popularity of this sport, there has also been a greater emphasis on snowboard rentals whereby a user can rent a snowboard for one or more days and return the snowboard at the end of the rental period, such that a given snowboard will be used by many different types of users during a season. It would be desirable to provide a quick and easy method of adjustment for such rental boards to allow the board to be easily adapted for different users.

Another problem for snowboarders is that when traversing a flat or unsloped area, users generally remove the back foot from the back binding and use that foot to push the board forward, or walk using an awkward shuffling movement, due to the direction of the board relative to the user's feet. It would be preferable to be able to redirect the front foot and binding in the forward direction in order to allow the user to manipulate the board more easily, especially while moving through the line at a lift before riding thereon. It is also easier for riding on a lift if the board is generally aligned with one foot, as opposed to being generally perpendicular.

Once a user determines a desired board position, it would be desirable to be able to return one or both bindings to the desired optimum position for the given user, while at the same time retaining the ability for adjustment and/or readjustment to various other positions, especially in the case of rental equipment.

In one known prior art device, a customized binding/mounting plate is provided to provide pivotable mounting of a binding to a snowboard. However, this arrangement can only be used with the specifically designed binding. It would also be desirable to provide a universal adapter assembly which will receive any desired type of binding, since the selection of bindings that may be chosen is also be dependent upon the type of snowboarding activity desired.

SUMMARY OF THE INVENTION

Briefly stated, the present invention provides an adapter assembly for pivotable mounting of a binding to a snowboard. The adapter assembly includes a first part which is adapted to be one of mounted to a snowboard and connected to a binding. A second part is rotatably connected to the first part for rotation about an axis. The second part is adapted to be the other of mounted to the snowboard and connected to the binding. The first part includes an index member having a plurality of index stops spaced at least partially around the axis. A locating member is connected to the second part which is movable from a first position, where the locating member is engaged in an index stop of the index member such that the second part is held in a rotatably fixed position relative to the first part, to a second position, where the locating member is disengaged from the index stops of the index member such that the second part is rotatable relative to the first part. A repeat stop selector is also provided which is positionable relative to the index member for realignment of the locating member with a pre-selected one of the index stops after movement of the first part relative to the second part.

In another aspect, the present invention provides an adapter assembly for pivotable mounting of a binding to a snowboard. The adapter assembly includes an index member which is adapted to be one of mounted to a snowboard and connected to a binding. A housing is rotatably connected to the index member for rotation about an axis relative to the index member. The housing is adapted to be the other mounted to the snowboard and connected to the binding. The index member includes a plurality of teeth with a plurality of spaces located therebetween which provide a plurality of index stops spaced at least partially about the axis. A locating member is connected to the housing which is movable from a first position, where the locating member engages a selected index stop such that the housing is held in a rotatably fixed position relative to the index member, to a second position, where the locating member is disengaged from the index member such that the housing is rotatable relative to the index member. A repeat stop selector is provided which is positionable relative to the index member for realignment of the locating member with a preselected one of the index stops after moving of the index member relative to the housing. The repeat stop selector has a generally circular outer periphery with a second plurality of teeth located thereon, an axially extending ring-shaped portion offset from the outer periphery, and an axially projecting bump located between the ring-shaped portion and the outer periphery. The repeat stop selector is rotatable relative to the index member and the housing to position the bump at the preselected index stop location.

BRIEF DESCRIPTION OF THE SEVERAL VIEWS OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
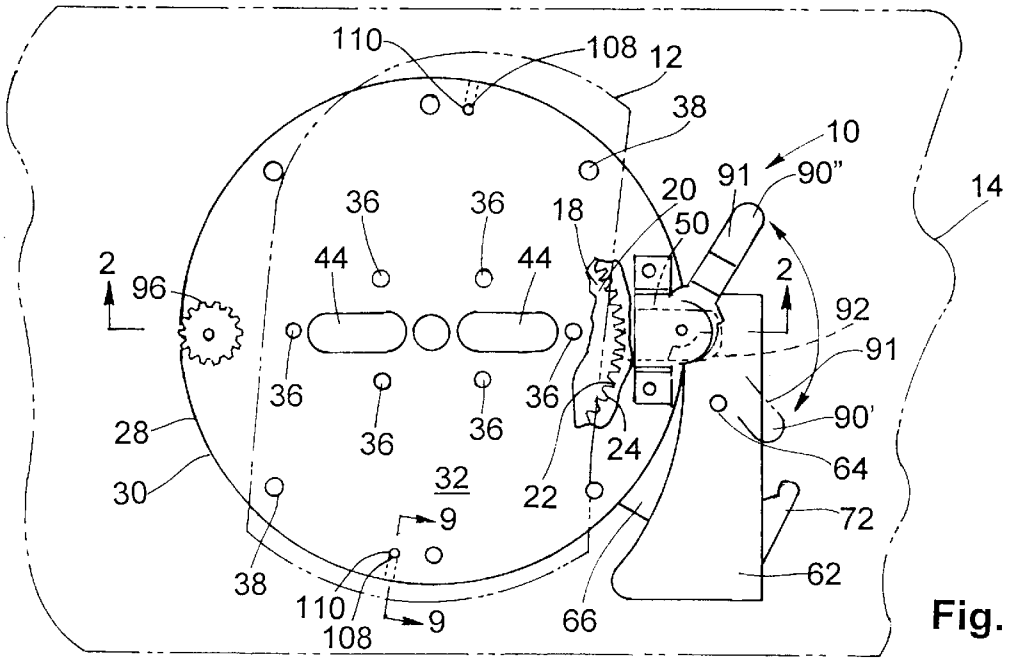
FIG. 1 is a top plan view of a preferred embodiment of an adapter assembly for pivotable mounting of a binding to a snowboard in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of an adapter for pivotable mounting of a binding to a snowboard in accordance with the present invention and designated parts thereof. The terminology includes the words above specifically mentioned, derivatives thereof and words of similar import.

Referring to the drawings, wherein the same reference numerals are used to indicate the same elements throughout, there is shown in FIG. 1 a preferred embodiment of an adapter assembly 10 for pivotable mounting of a binding 12 to a snowboard 14. While only a single adapter assembly 10 is shown, it will be recognized by those skilled in the art from the present disclosure that two adapter assemblies 10 can be used on the snowboard 14 with one being associated with each binding 12. Alternatively, a single adapter assembly 10 can be used for the forward foot of a user since the user's back foot is typically released from the binding 12 for traversing flat ground. A suitable spacer (not shown) can be used to adjust the height of the rear binding (not shown) if two adapter assemblies 10 are not used.

Figure 2:
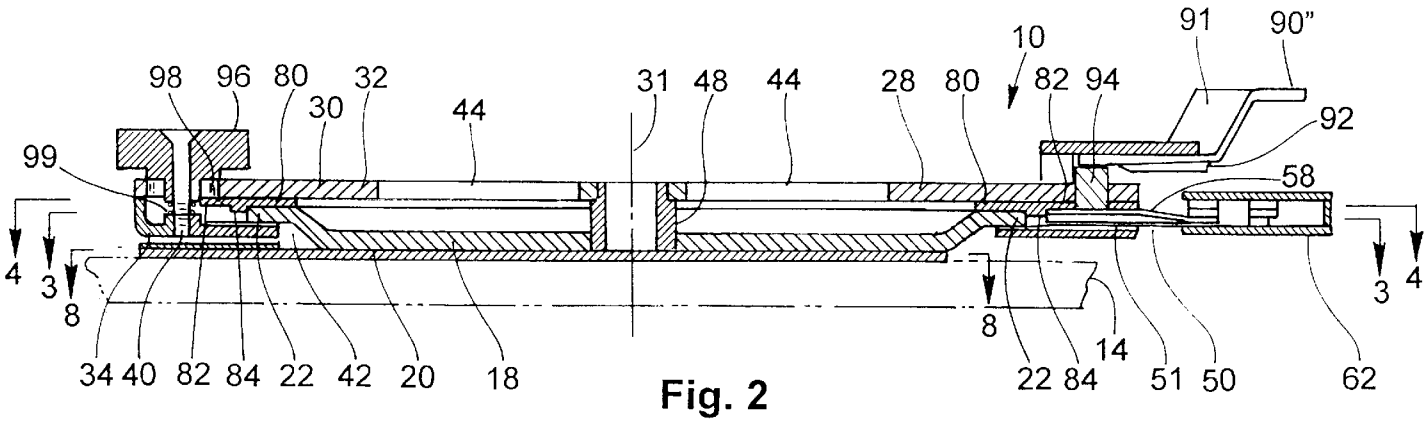
FIG. 2 is an enlarged cross-sectional view of the preferred embodiment of the adapter assembly taken along lines of 2—2 and FIG. 1.

As shown in FIGS. 1 and 2, the adapter assembly 10 includes a first part 18 which is adapted to be one of mounted to the snowboard 14 and connected to the binding 12 (and is shown as being mounted to the snowboard 14). A second part 28 is rotatably connected to the first part 18 for rotation about an axis 31, shown in FIG. 2. The second part 28 is adapted to be the other of mounted to the snowboard 14 and connected to the binding 12 (and in the illustrated embodiment is adapted to be connected to the binding 12). In the preferred embodiment, the first part 18 comprises an index member 20 having a plurality of index stops 22 spaced at least partially around the axis 31. Preferably, the index member 20 is a toothed member in the form of a gear, as shown in detail in FIGS. 2 and 4, and the index stops are formed by the radially extending teeth 24 on the index member 20. As shown in FIG. 2, the index member 20 is preferably connected to the snowboard 14. However, it will be recognized by those skilled in the art from the present disclosure that the index member 20 can have other forms, such as a member having a plurality of holes, axially extending teeth, or other indexing means located at least partially about the axis 31 which defines the center of rotation of the first part 18 relative to the second part 28.

In the preferred embodiment of the adapter assembly 10, ninety teeth 24 are provided on the first part 18 providing adjustment of four degree increments about a 360° adjustment range. Preferably, the first part 18 is made of aluminum or an aluminum alloy. However, it will be recognized by those skilled in the art from the present disclosure that it may be made of stainless steel or any other suitable material.

Figure 4:
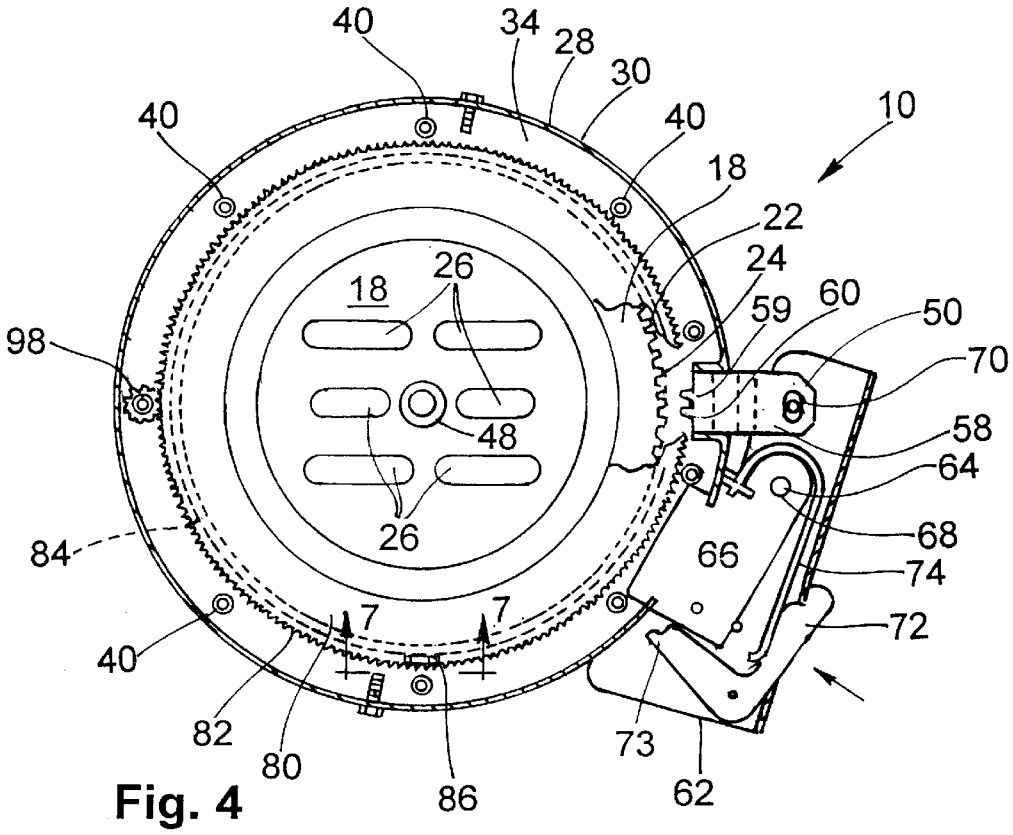
FIG. 4 is a top view of the adapter assembly shown in FIG. 2, taken along lines 4—4 and FIG. 2.
Figure 3:
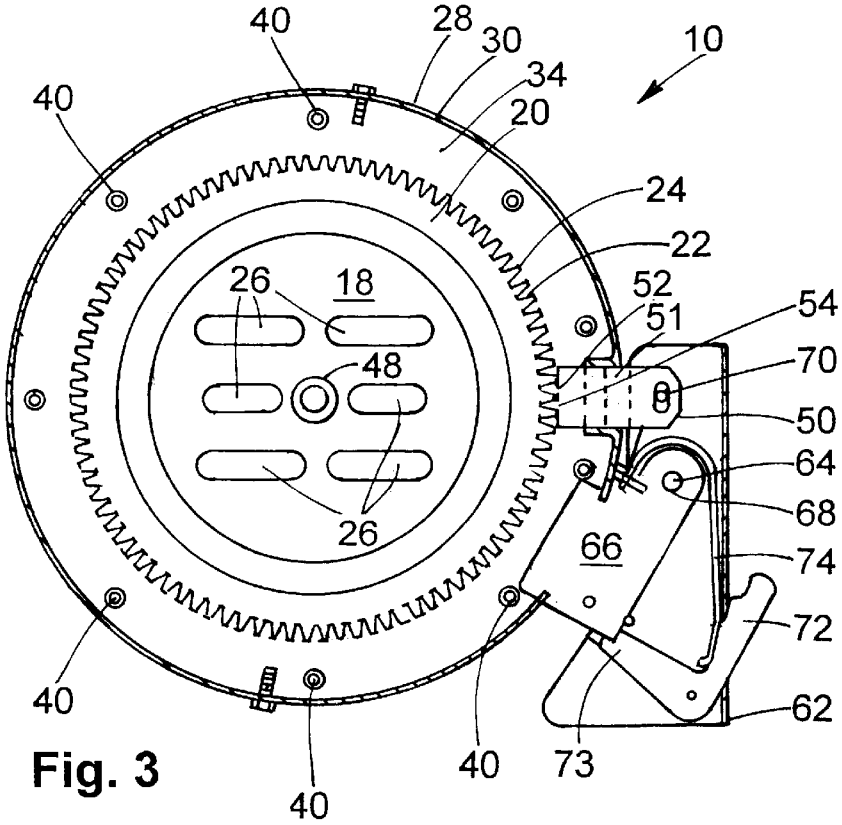
FIG. 3 is a top view of the preferred embodiment of the adapter assembly shown in FIG. 2, taken along lines 3—3 and FIG. 2.

As shown in detail in FIGS. 2–4, the second part 28 preferably comprises a housing 30 having an upper plate 32 and a bottom portion 34. The upper plate 32 includes holes 36 for connecting the binding 12 to the upper plate. Additional holes 38 are provided in which screws or other fasteners are inserted for connecting the upper plate 32 to the bottom portion 34. The bottom portion preferably includes threaded apertures 40 for receiving the screws. As shown in FIG. 2, the bottom portion 34 preferably includes an opening 42 through which the index member 20 protrudes for attachment to the snowboard 14. However, it will be recognized by those skilled in the art from the present disclosure that the first part 18 and the second part 28 could be reversed such that the second part 28 comprising the housing 30 is connected to the snowboard 14 and the first part 18 comprising the index member 20 can be used for connection to the binding 12. Preferably, the upper plate 32 is made of aluminum or an aluminum alloy and the bottom portion 34 is made of stainless steel. However, any other suitable materials having the desired strength may be used for the upper plate 32 and bottom portion 34, if desired.

Preferably, elongated slots 44, shown in FIG. 1, are provided in the top plate 32 to allow access to the mounting holes 26 in the first part 18, shown in detail in FIGS. 3 and 4. Preferably, a bushing 48 is connected between the first part 18 and the second part 28 along the axis 31. The bushing 48 keeps the first part 18 and second part 28 concentrically aligned and allows for rotation of the second part 28 relative to the first part 18. The bushing 48 is made of bronze or any other suitable bearing material.

As shown in FIGS. 1–6, a locating member 50 is connected to the second part 28 and is movable from a first position, as shown in FIG. 3 where the locating member 50 is engaged in an index stop 22 of the index member 20 such that the second part 28 is held in a rotatably fixed position relative to the first part 18, to a second position, as shown in FIG. 4, where the locating member 50 is disengaged from the index stops 22 of the index member 20 such that the second part 28 is rotatable relative to the first part 18. As shown in detail in FIGS. 2 and 3, preferably the locating member 50 comprises a plate-shaped, radially actuatable lock member 51 having at least one tooth 52 and preferably two teeth 52, 54 which engage one or more of the teeth 24 on the index member 20 in the first position.

Figure 5:
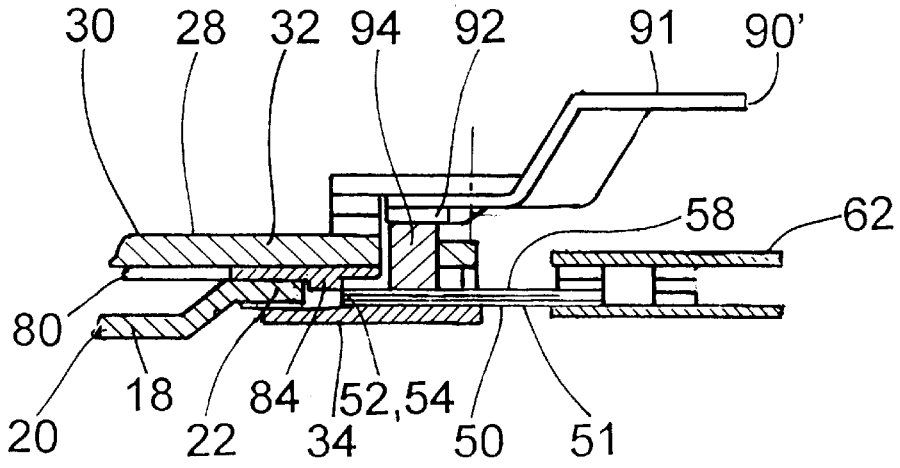
FIG. 5 is a partial enlarged cross-sectional view of the preferred embodiment of the adapter assembly similar to FIG. 2 showing the control member in a third position such that the repeat stop selector is not activated.

As shown in FIGS. 2, 4 and 5, the locating member 50 preferably includes a spring member 58 which is formed of flat spring stock, which has the same profile as, and is aligned with and positioned over the lock member 51. The spring member 58 preferably includes two teeth 59, 60, (shown in FIG. 4) having the same shape as the teeth 52, 54 of the lock member 51, which also engage the selected index stop 22. As shown in FIG. 4, where a portion of the repeat stop selector 80 is broken away, in the second position, the teeth 52, 54 and of the lock member 51 and the teeth 59, 60 of the spring member 58 are disengaged from the teeth 24 of the index member 20.

The spring member 58 is used in connection with the repeat stop selector 80. However, it will be recognized by those skilled in the art from the present disclosure that the spring member 58 need not include a portion, such as the teeth 59, 60 which is engagable with the index stops 22 of the first part 18, and may be used to function only as a part of the system for realignment of the locking member 51 with the preselected one of the index stops 22 after movement of the first part 18 relative to the second part 28, as explained in detail below.

As shown in FIGS. 1, 3 and 4, preferably the locating member 50 is connected to a lever 62 which is pivotable about an axis 64. The lever 62 is connected to a projection 66 which extends from the housing 30 via a pin 68 located along the axis 64. The locating member 50, including the lock member 51 and the spring member 58, is connected to the lever 62 via a pin 70 which is positioned in aligned slots in the lock and spring members 51, 58. As shown in detail in FIG. 3, a leaf spring 74 is used to bias the lever 62 and the locating member 50 toward the first position, as shown in FIG. 3. A release member 72 is located on the lever 62 and includes an end 73 which engages a portion of the projection 66 from the housing 30 to lock the lever 62 and the locating member 50 in the first position. As shown in FIG. 4, the release member 72 can be pressed inwardly to disengage the end 73 from the projection 66 against the force of spring 74 in order to allow the lever 62 to be moved inwardly to withdraw the locating member 50 to the second position where the locating member 50 is disengaged from the stops 22 of the index member 20.

Referring to FIGS. 2 and 4, a repeat stop selector 80 which is positionable relative to the index member 20 for realignment of the locating member 50 with a preselected one of the index stops 22 after movement of the first part 18 relative to the second part 28 is provided. As shown in detail in FIGS. 2, 4 and 6, the repeat stop selector 80 is preferably in a form of an annular ring having a plurality of teeth 82 located thereon. The repeat stop selector 80 is located between the housing 30 and the index member 20 and is rotatable relative to the locating member 50 attached to the housing 30 and the index member 20. Preferably, an axially extending ring-shaped portion 84 is offset from the outer periphery and extends downwardly from the repeat stop selector 80. An axially projecting bump 86, shown in FIGS. 4, 6 and 7, is located between the axially offset ring-shaped portion 84 and the outer periphery of the repeat stop selector 80.

The repeat stop selector 80 is selectively activatable by the user via a control member 90. As shown in FIGS. 1, 2 and 5, the control member 90 comprises a lever 91 having a bump 92 defined thereon. The control member 90 is movable between a third position, shown as 90' in FIGS. 1 and 5, and a fourth position, shown as 90" in FIGS. 1 and 6. In the third position illustrated as 90' in FIGS. 1 and 5, the lever 91 is in the non-activated position, with the bump 92 of the lever 91 pressing downwardly on a spacer block 94. The spacer block 94 depresses the spring member 58 from the position shown in FIG. 2 to the position shown in FIG. 5, where the spring member 58 is positioned below the offset ring-shaped portion 84 of the repeat stop selector 80. This allows the lock member 51 or both the lock member 51 and the spring member 58 to be engaged or disengaged from the index stops 22 of the first part 18, regardless of the position of the locating member 50 with respect to the first part 18. Accordingly, the lever 62 for the locating member 50 can be moved between the first and second positions, as shown in FIGS. 3 and 4 for any relative position of the second part 28 relative to the first part 18 by pressing and holding the lever 62 inwardly. When the lever 62 is released, the spring 74 forces the lever 62 back to the position shown in FIG. 3 causing the locating member 50 to spring back to the first position.

Figure 6:
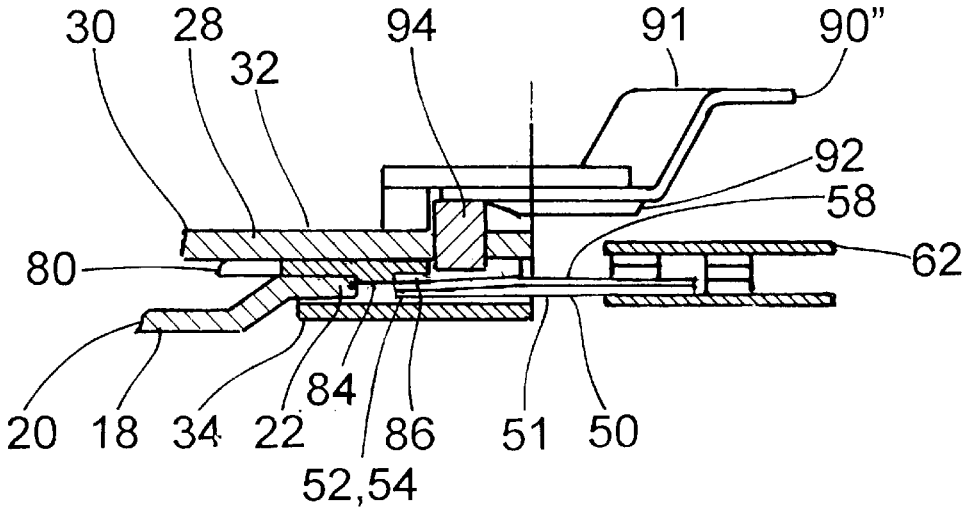
FIG. 6 is a partial enlarged cross-sectional view of the preferred embodiment of the adapter assembly similar to FIG. 2 showing the control member in a fourth position, to activate the repeat stop selector, with the repeat stop selector in alignment with the locating member such that a preselected one of the index stops can be engaged.
Figure 7:
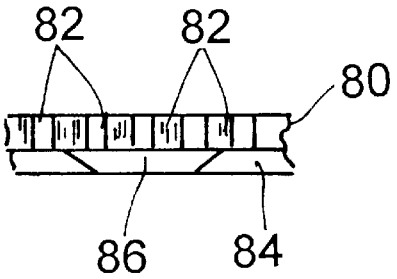
FIG. 7 is an enlarged cross-section taken along lines 7—7 in FIG. 4.

When the lever 91 is in the fourth position designated 90", as shown in FIGS. 1, 2 and 6, the locating member 50 is only movable from the second position (shown in FIG. 4) to the first position (shown in FIG. 3) when the bump 86 of the repeat stop selector 80 (illustrated in dashed lines at the 6 o'clock position in FIG. 3 and shown in detail in FIGS. 6 and 7) is aligned with the locating member 50 such that the spring member 58 is depressed to a position where it can pass beneath the axially offset ring-shaped portion 84 of the repeat stop selector 80.

Referring now to FIGS. 1–3, the position of the repeat stop selector 80 can be adjusted using an adjustment knob 96 which is mounted on the housing 30. As shown in FIGS. 2 and 3, the adjustment knob 96 includes a spur gear 98 with complementary teeth to the teeth 82 of the repeat stop selector 80. The adjustment knob 96 and the gear 98 are biased to a position out of contact with the teeth 82 of the repeat stop selector 80 via a spring 99, as shown in FIG. 2. The adjustment knob 96 can be pressed downwardly by the user such that the teeth of the spur gear 98 engage the teeth 82 of the repeat stop selector 80, and by turning the adjustment knob 96, the position of the bump 86 on the repeat stop selector 80 can be moved to any desired location 360° around the axis 31, adjusting the position of the repeat stop selector 80 relative to the locating member 50 on the housing 30 as well as the index member 20. Once the repeat stop selector 80 has been moved to the desired position, the adjustment knob 96 is released, and the spring 99 lifts the teeth of the spur gear 98 out of contact with the teeth 82 of the repeat stop selector 80. The repeat stop selector 80 is held in position relative to the first part 18 by friction at the overlapping contact area with the first part 18. Alternatively, one or more bumps (not shown) may be provided on one of the repeat stop selector 80 and the first part 18 in the contact area, and a plurality of recesses (not shown) provided on the other of the repeat stop selector 80 and the first part 18 to create a more secure engagement between the repeat stop selector 80 and the first part 18.

Figure 8:
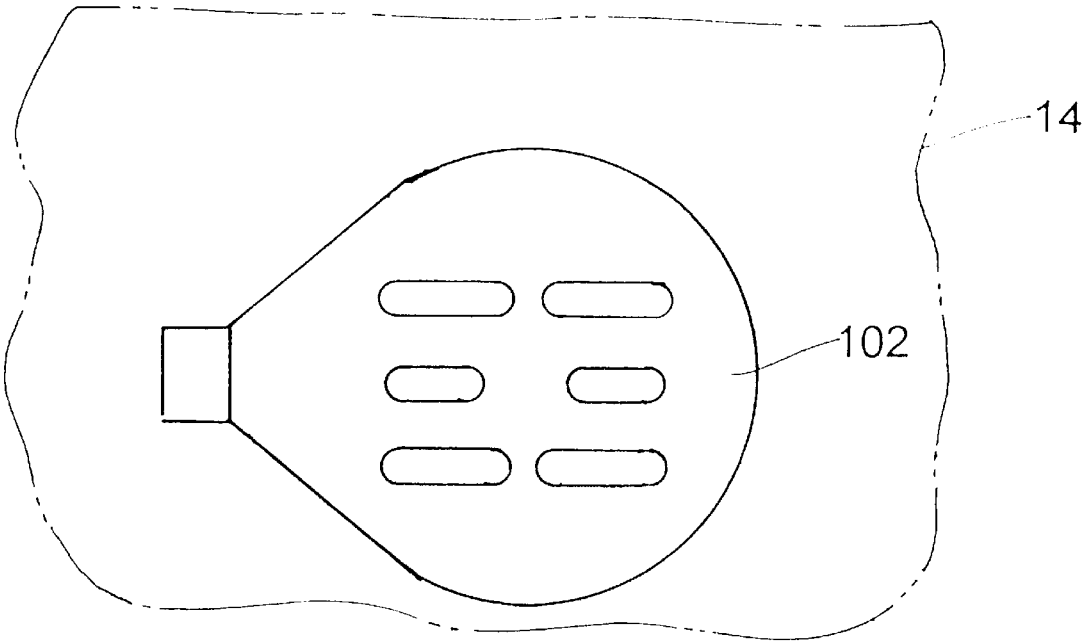
FIG. 8 is a top view of a movement limiter plate taken along lines 8—8 in FIG. 2.
Figure 9:
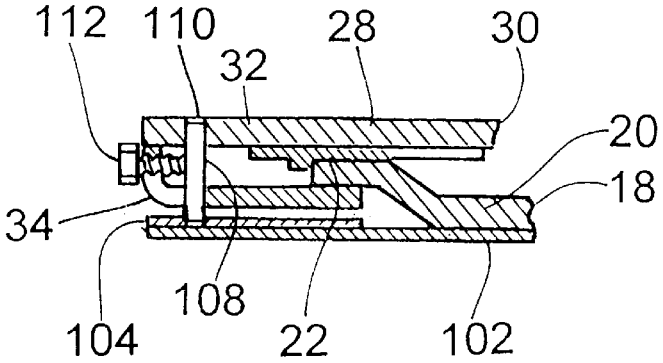
FIG. 9 is a partial enlarged cross-sectional view of the preferred embodiment of the adapter assembly similar to FIG. 2 showing a stop pin contacting the movement limiter to prevent further movement of the binding past the position where the binding is generally aligned with the snowboard.

Referring now to FIGS. 2, 8 and 9, a limiter plate 102 is preferably mounted between the first part 18 and the snowboard 14. The limiter plate 102 includes a raised stop 104 which is oriented toward the front of the snowboard 14. Preferably, the limiter plate 102 includes a complementary hole pattern to the mounting holes 26 of the first part 18, and is connected to the snowboard 14 using the same fasteners. The limiter plate 102 is preferably made of aluminum or an aluminum alloy, but may be made of any other suitable material having the desired strength.

As shown in FIGS. 1 and 9, preferably two holes 110 are provided in the housing 30 in which a stop pin 108 is received. The stop pin 108 extends below the bottom portion 34 of the housing 30 to a height where it will contact the raised stop 104 on the limiter plate 102 when the binding 12 and the housing 30 are oriented generally parallel to the direction of the snowboard 14. The stop pin 108 is held in position with a fastener 112, as shown in FIG. 9. The height of the stop pin 108 can be adjusted via the fastener 112. Depending upon whether the user places the left foot forward or the right foot forward, the stop pin 108 may be repositioned in one or the other of the two holes 110 provided in the housing 30.

In use, prior to the determination of a preselected position for repeatable alignment of the binding 12, the control member 90 is placed in the position illustrated as 90' in FIGS. 1 and 5. In this position, the locating member 50 can be moved between the first and second positions, as shown in FIGS. 3 and 4, respectively, by the user pressing inwardly on the release member 72 of the lever 62. The user can then change the position of the binding 12, as desired, and lock the binding 12 in a desired position by releasing the lever 62, such that the spring 74 returns the lever 62 and the locating member 50 to the first, engaged position. Additionally, this allows a snowboard 14 having an adapter assembly 10 for each binding, such as snowboards provided by rental shops to be adjusted for a user that prefers either the right foot or the left foot as the forward foot. For traversing flat ground, the user can easily align the forward binding 12 with the snowboard by rotating the housing 30 with the attached binding 12 until the stop pin 108 contacts the stop 104 on the limiter plate 102.

Once the user has established a preselected location which provides the desired level of comfort for the user and the user wishes to be able to repeatedly select this desired binding location, the control member 90 is moved to the position illustrated as 90" in FIG. 1. The user then presses inwardly on the release member 72 and the lever 62. Once the locating member 50 is in the second position, the user releases the lever 62. The spring 74 will urge the lever 62 and the locating member 50 back toward the first position. However, the axially extending ring-shaped portion 84 of the repeat stop selector 80 prevents re-engagement of the locating member 50. The user then presses downwardly on the adjustment knob 96 so that the spur gear 98 engages the teeth 82 on the repeat stop selector 80. The position of the repeat stop selector 80 is adjusted by turning the adjustment knob 96 until the bump 86 on the repeat stop selector 80 is aligned with the locating member 50, as shown in FIG. 6. The bump 86 deflects the spring member 58 to a position below the axially extending ring-shaped portion, and the spring 74 then moves the lever 62 and the locating member 50 back to the first position where at least the teeth 52, 54 of the lock member 51 engage the teeth 24 of the first part 18. Thereafter, when the user presses the release member 72 to move the lever 62 and the locating member 50 from the first position, as shown in FIG. 3, to the second position, as shown in FIG. 4, and turns the binding 12 and the second part 28, such as when the user is moving across a flat area or when the user desires to have one foot aligned in the direction of the board 14 after releasing the second foot from the board 14 in order to move through a lift line or ride a lift back to the top of the hill, the locating member 50 cannot be re-engaged until the second part 28 is again rotated to the desired position such that the bump 86 on the repeat stop selector 80 deflects the spring member 58 in order to allow the locating member 50 to be re-engaged with the preselected index stop 22. However, the forward binding 12 and housing 30 can be easily maintained in an aligned position with the snowboard 14 for traversing flat ground by the stop pin 108 in the housing 30 contacting the stop 104 on the limiter plate 102.

While the preferred embodiment has been described with the first part 18 being connected to the snowboard 14, it will be recognized by those skilled in the art from the present disclosure that the second part 28 could be connected to the snowboard 14 and the first part 18 could be used for connection to the binding 12 by changing the position of the adjustment knob 96 and the control member 90. It will be similarly recognized that the mounting pattern for connecting the binding 12 to the adapter assembly 10 can be varied to suit any desired binding selected by a user. While the stop pin 108 and limiter plate 102 arrangement are preferred, it will be recognized by those skilled in the art that they may be omitted, if desired.

It will be appreciated by those skilled in the art that changes can be made to the embodiments described above without departing from the broad inventive concept. It is understood, therefore, that this invention is not limited to the particular embodiments disclosed, but it is intended to cover modifications within the spirit and scope of the present invention.

We claim:

1. An adapter assembly for pivotable mounting of a binding to a snowboard comprising:

a first part adapted to be one of mounted to a snowboard and connected to a binding;

a second part rotatably connected to the first part for rotation about an axis, the second part being adapted to be the other of mounted to the snowboard and connected to the binding;

the first part including an index member having a plurality of index stops spaced at least partially around the axis;

a locating member connected to the second part which is movable from a first position, where the locating member is engaged in an index stop of the index member such that the second part is held in a rotatably fixed position relative to the first part, to a second position, where the locating member is disengaged from the index stops of the index member such that the second part is rotatable relative to the first part; and a repeat stop selector which is positionable relative to the index member for realignment of the locating member with a preselected one of the index stops after movement of the first part relative to the second part.

2. The adapter assembly of claim 1 wherein the repeat stop selector is selectively activatable by a control member.

3. The adapter assembly of claim 2 wherein upon activation of the repeat stop selector, the locating member can only be moved to the first position at the preselected index stop.

4. The adapter assembly of claim 1 wherein the first part comprises a toothed member, the second part is a housing rotatably connected to the toothed member, and the repeat stop selector is located between the housing and the toothed member and is rotatable relative to the locating member and the toothed member.

5. The adapter assembly of claim 4 wherein the repeat stop selector includes a plurality of teeth, and an adjustment knob having a spur gear with complementary teeth is connected to the housing such that the teeth of the spur gear can be moved into contact with the teeth of the repeat stop selector for adjusting the position of the repeat stop selector relative to the locating member and the toothed member to the preselected index stop.

6. The adapter assembly of claim 1 wherein the locating member includes a radially actuatable lock member and a spring member, at least the radially actuatable lock member engages at least one index stop on the first part when the locating member is in the first position.

7. The adapter assembly of claim 6 wherein a control member is provided for selectively activating the repeat stop selector, the control member being moveable between a first control member position, where the control member deflects the spring member such that the lock member is adapted to be moved to the first position and engaged with any of the plurality of index stops, and a second control member position, where the spring member is released such that the spring member prevents movement of the lock member until the lock member is positioned at the preselected index stop.

8. The adapter assembly of claim 7 wherein the repeat stop selector includes a bump which deflects the spring member at the preselected index stop such that the lock member is adapted to be engaged to the preselected index stop.

9. The adapter assembly of claim 1 wherein the repeat stop selector is adapted to be located at any desired location around the axis.

10. An adapter assembly for pivotable mounting of a binding to a snowboard comprising:

an index member adapted to be one of mounted to a snowboard and connected to a binding;

a housing rotatably connected to the index member for rotation about an axis relative to the index member, the housing being adapted to be the other of mounted to the snowboard and connected to the binding;

the index member including a plurality of teeth with a plurality of spaces located therebetween which provide a plurality of index stops spaced at least partially about the axis;

a locating member connected to the housing which is movable from a first position, where the locating member engages a selected index stop such that the housing is held in a rotatably fixed position relative to the index member, to a second position, where the locating member is disengaged from the index member such that the housing is rotatable relative to the index member; and a repeat stop selector which is positionable relative to the index member for realignment of the locating member with a preselected one of the index stops after movement of the index member relative to the housing, the repeat stop selector having a circular outer periphery with a second plurality of teeth located thereon, an axially extending ring-shaped portion offset from the outer periphery, and an axially projecting bump located between the ring-shaped portion and the outer periphery, the repeat stop selector being rotatable relative to the index member and the housing to position the bump at the preselected index stop location.

11. The adapter assembly of claim 10 wherein the repeat stop selector being selectively activatable by a control member.

12. The adapter assembly of claim 11 wherein the locating member includes a radially actuatable lock member and a spring member, the radially actuatable lock member is adapted to engage at least one index stop on the index member.

13. The adapter assembly of claim 12 wherein the control member selectively activates the repeat stop selector by releasing pressure on the spring member such that the spring member is in alignment with the axially extending ring-shaped portion of the repeat stop selector which prevents movement of the locating member to the first position until the spring member is positioned at the bump on the repeat stop selector, to deflect the spring member such that the lock member is adapted to be engaged to the preselected index stop.

14. The adapter assembly of claim 10 wherein an adjustment knob having a spur gear with complementary teeth to the teeth on the repeat stop selector is connected to the housing such that the teeth of the spur gear can be moved into contact with the teeth of the repeat stop selector to adjust the position of the repeat stop selector relative to the housing and the index member.

* * * * *